US006316867B1

(12) United States Patent
Roberts et al.

(10) Patent No.: US 6,316,867 B1
(45) Date of Patent: Nov. 13, 2001

(54) XENON ARC LAMP

(75) Inventors: Roy D. Roberts, Hayward; Rodney O. Romero, Sunnyvale, both of CA (US)

(73) Assignee: EG&G ILC Technology, Inc., Sunnyvale, CA (US)

( * ) Notice: Subject to any disclaimer, the term of this patent is extended or adjusted under 35 U.S.C. 154(b) by 0 days.

(21) Appl. No.: 09/427,851

(22) Filed: Oct. 26, 1999

(51) Int. Cl.[7] ..... H01J 61/16; H01J 61/98

(52) U.S. Cl. ..... 313/113; 313/623; 313/634; 313/110; 313/570; 313/573; 313/574; 315/246

(58) Field of Search ..... 313/623, 113, 313/634, 570, 573, 574, 110; 315/246

(56) References Cited

U.S. PATENT DOCUMENTS 4,940,922 * 7/1990 Schuda et al. ..... 315/246
6,114,807 * 9/2000 Kavanagh ..... 313/570
6,135,840 * 10/2000 Kanzaki ..... 445/26
6,181,053 * 1/2001 Roberts ..... 313/46

FOREIGN PATENT DOCUMENTS 2000-277054 * 10/2000 (JP) ..... H01J/61/36

* cited by examiner

*Primary Examiner*—Nimeshkumar D. Patel
*Assistant Examiner*—Sikha Roy
(74) *Attorney, Agent, or Firm*—Thomas E. Schatzel; Law Offices of Thomas E. Schatzel, A. Prof. Corp.

(57) ABSTRACT

A low-cost ceramic arc lamp comprises an optical coating on a sapphire window, a window shell flange, and a body sleeve. A gas-fill tubulation attaches to the side of the body sleeve and permits a charge of xenon gas to be injected during manufacture. This contrasts with the prior art where the xenon gas is introduced through the anode base. A single-piece strut assembly is used that is compatible with mass-production techniques. The single-piece strut assembly supports and suspends a cathode inside an elliptical reflector. An anode flange replaces a more conventional shell, copper anode base, and base support ring. A tungsten anode completes the lamp. All of these parts are brazed together in an assembly process that is far less complex than the prior art.

6 Claims, 3 Drawing Sheets

XENON ARC LAMP

BACKGROUND OF THE INVENTION

1. Field of the Invention

The invention relates generally to arc lamps, and specifically to components and methods used to reduce the cost of manufacturing xenon arc lamps.

2. Description of the Prior Art

Short arc lamps provide intense point sources of light that allow light collection in reflectors for applications in medical endoscopes, instrumentation and video projection. Also, short arc lamps are used in industrial endoscopes, for example in the inspection of jet engine interiors. More recent applications have been in color television receiver projection systems.

A typical short arc lamp comprises an anode and a sharp-tipped cathode positioned along the longitudinal axis of a cylindrical, sealed concave chamber that contains xenon gas pressurized to several atmospheres. U.S. Pat. No. 5,721,465, issued Feb. 24, 1998, to Roy D. Roberts, describes such a typical short-arc lamp. A typical xenon arc lamp, such as the CERMAX marketed by ILC Technology (Sunnyvale, Calif.) has a three-legged strut system that holds the cathode electrode concentric to the lamp's axis and in opposition to the anode.

The manufacture of high power xenon arc lamps involves the use of expensive and exotic materials and sophisticated fabrication, welding, and brazing procedures. Because of the large numbers of xenon arc lamps being produced and marketed, every opportunity to save money on the materials and/or assembly procedures is constantly being sought. Being the low-cost producer in a market always translates into a strategic competitive advantage.

For example, the CERMAX-type arc lamp 100 shown in FIG. 1 and sold in the commercial market can easily require as much as forty-eight percent in material costs and fifty-two percent in labor costs. The total manufacturing cost acts to set the minimum amount that can be charged at retail. The supply-versus-demand rule therefore tends to limit the production volumes that can be sold because of the high price points that must be charged. The lamp 100 is conventional and comprises an optical coating 102 on a sapphire window 104, a window shell flange 106, a body sleeve 108, a pair of flanges 110 and 112, a three-piece strut assembly 114, a two percent thoria cathode 116, an alumina-ceramic elliptical reflector 118, a metal shell 120, a copper anode base 122, a base support ring 124, a tungsten anode 126, a gas tubulation 128, and a charge of xenon gas 130. All of which are brazed together in a complex assembly process. Fewer parts, less expensive materials, simpler tooling, and fewer assembly steps would all help to reduce the costs of making such CERMAX-type arc lamps.

SUMMARY OF THE PRESENT INVENTION

It is therefore an object of the present invention to provide a xenon ceramic lamp that is less expensive to produce than conventional designs.

It is another object of the present invention to provide a low-cost xenon ceramic lamp that works equally as well as more expensive conventional designs.

Briefly, an arc lamp embodiment of the present invention comprises an optical coating on a sapphire window, a window shell flange, and a body sleeve. A gas-fill tubulation attaches to the side of the body sleeve and permits a charge of xenon gas to be injected during manufacture. This contrasts with the prior art where the xenon gas is introduced through the anode base. A single-piece strut assembly is used that is compatible with mass-production techniques. The single-piece strut assembly supports and suspends a cathode inside an elliptical reflector. An anode flange replaces a more conventional shell, copper anode base, and base support ring. A tungsten anode completes the lamp. All of these parts are brazed together in an assembly process that is far less complex than the prior art.

An advantage of the present invention is that a ceramic arc lamp is provided that is less expensive to manufacture compared to prior art designs and methods.

These and other objects and advantages of the present invention will no doubt become obvious to those of ordinary skill in the art after having read the following detailed description of the preferred embodiments which are illustrated in the drawing figures.

IN THE DRAWINGS

Figure 3:
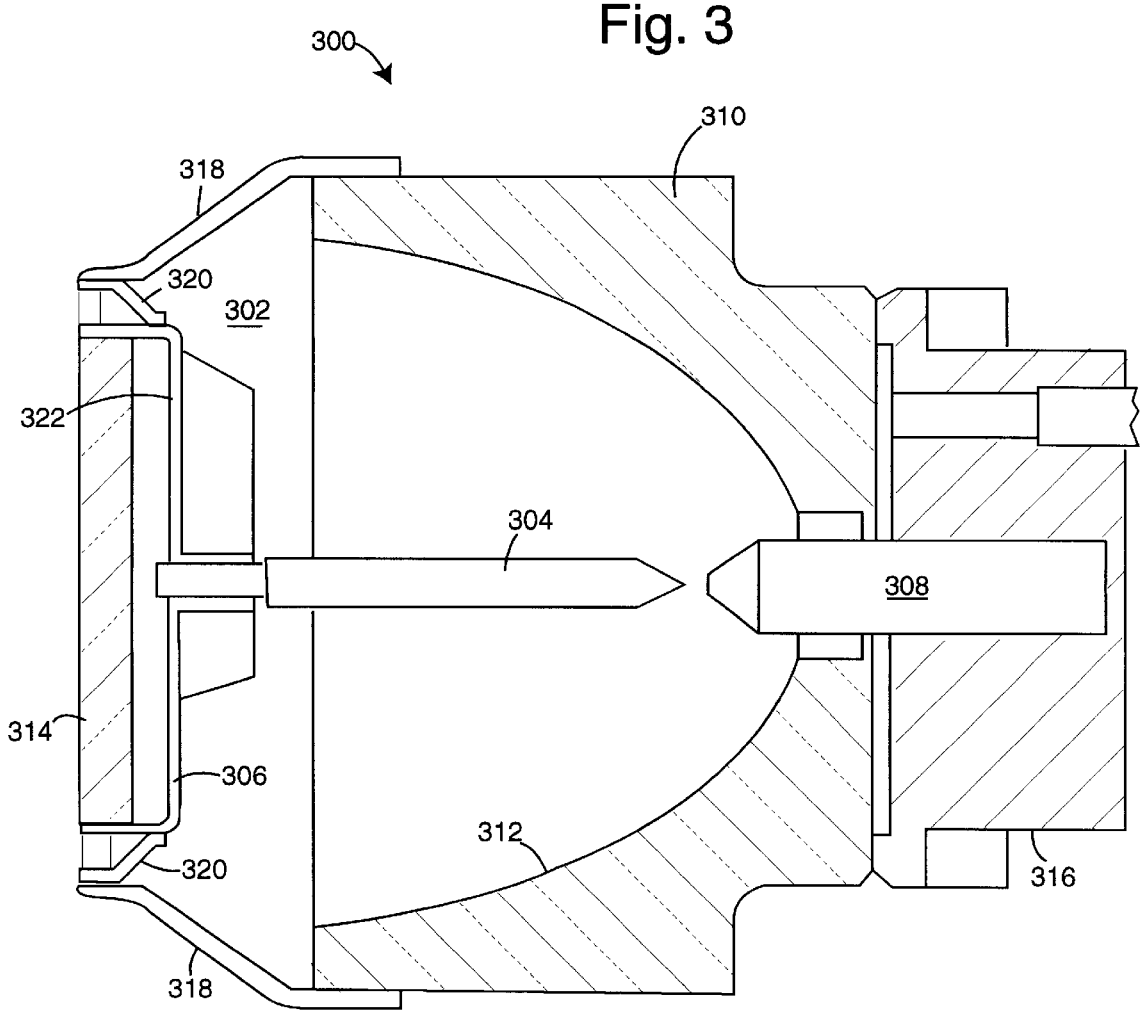
FIG. 3 is a cross-sectional diagram of a high-intensity short arc lamp embodiment of the present invention such as is shown in FIG. 2.
Figure 4A:
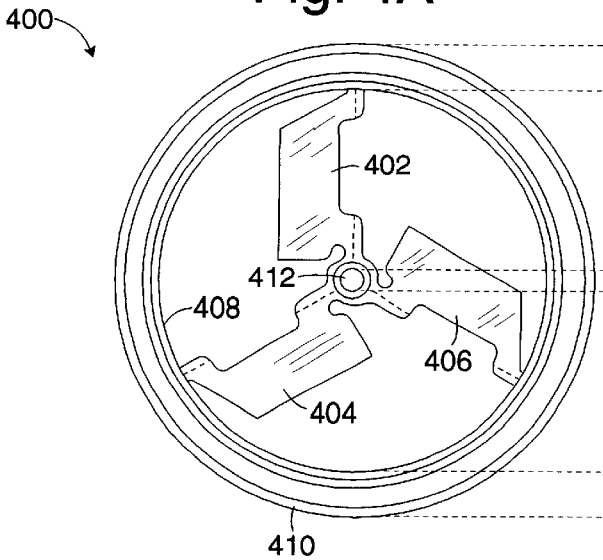
Figure 4B:
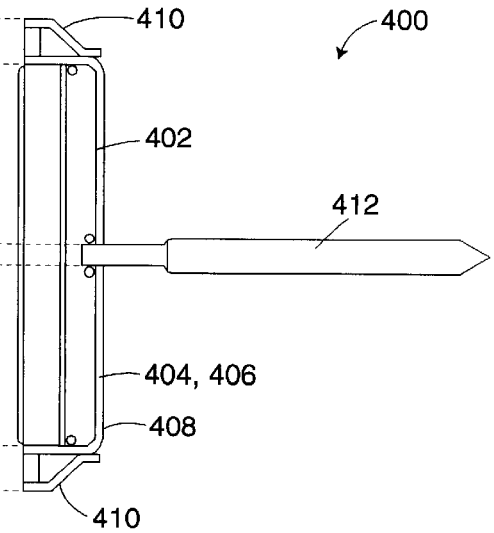
Figure 5A:
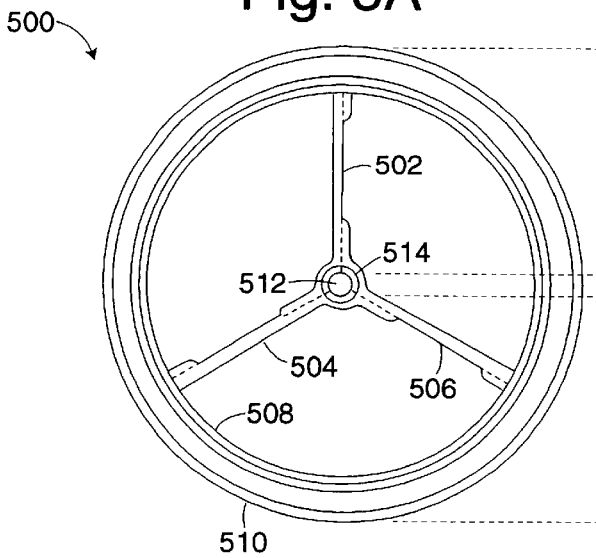
Figure 5B:
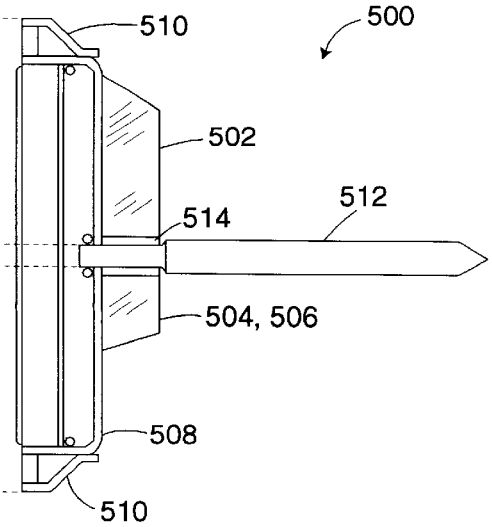

FIGS. 4A and 4B are end-view and side-view diagrams of a cathode support strut system embodiment of the present invention before the flaps on three webs are folded over, and is useful in the manufacture of the arc lamp of FIG. 3; and FIGS. 5A and 5B are end-view and side-view diagrams of the same cathode support strut system of FIGS. 4A and 4B, but after the flaps on the three webs have been folded over.

DETAILED DESCRIPTION OF THE PREFERRED EMBODIMENT

Figure 2:
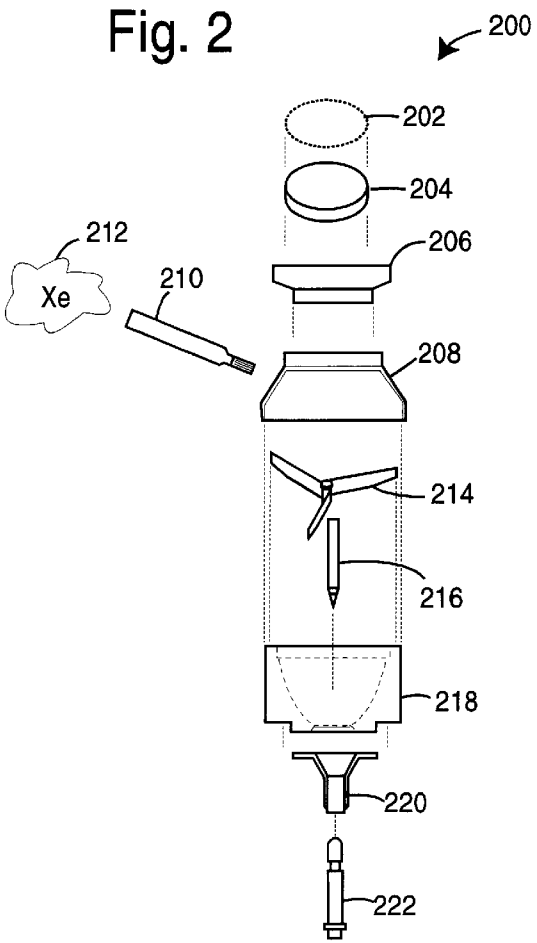
FIG. 2 is an exploded assembly diagram of a CERMAX-type arc lamp embodiment of the present invention.

FIG. 2 illustrates a xenon short-arc lamp, referred to herein by the general reference numeral 200. The lamp 200 comprises an optical coating 202 on a sapphire window 204, a window shell flange 206, and a body sleeve 208. A gas-fill tubulation 210 attaches to the side of the body sleeve 208 and permits a charge of xenon gas 212 to be injected during manufacture. This contrasts with the prior art represented in FIG. 1 where the xenon gas is introduced through the anode base.

A single-piece strut assembly 214 is used which is also very different from the prior art in the way that it is fabricated. Such is described in detail herein in connection with FIGS. 4A, 4B, 5A, and 5B. The single-piece strut assembly 214 has also been the subject of a separate U.S. patent application, Ser. No. 09/305,145, filed May 4, 1999. Such patent application is incorporated herein by reference.

The single-piece strut assembly 214 supports and suspends a cathode 216 inside an elliptical reflector 218. An anode flange 220 replaces a more conventional shell, copper anode base, and base support ring. A tungsten anode 222 completes the lamp 200. All of these parts are brazed together in an assembly process that is far less complex than the prior art.

Figure 1:
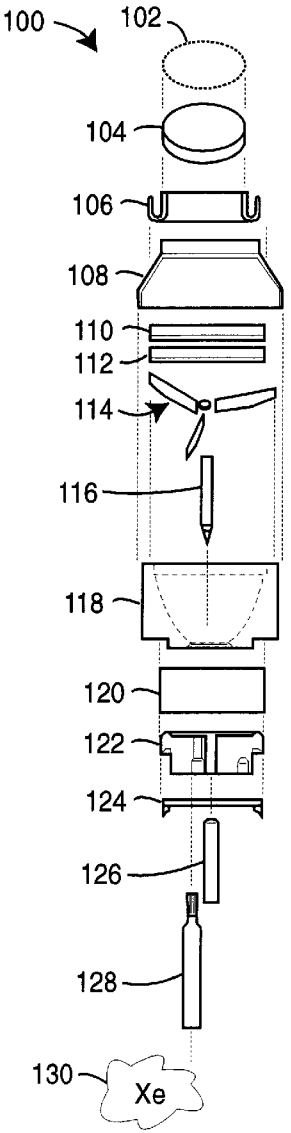
Fig. 1 PRIOR ART
FIG. 1 is an exploded assembly diagram of a prior art CERMAX-type arc lamp.

The anode flange 220 runs a bit hotter during operation than will the conventional anode base 122 (FIG. 1). This slight difference allows the lamp 200 to include a mercury doping in the xenon gas 212 that would otherwise condense in prior art lamps. Such mercury helps the lamp 200 produce an ultraviolet-rich output. This can be very useful in applications such as dental offices where such UV-light is needed to cure cements.

In particular, an RF-coil fed with high-power microwave energy is used to make the braze between the anode flange 220 and the tungsten anode 222. Before such braze is completed, the anode can be slipped in and out to set the arc gap. Conventional shims are thus eliminated from the lamp design by using a digitally controlled positioning tool that brings the anode and cathode electrodes briefly into contact, and then backs the anode 222 off through the anode flange 220 to set the required gap. The arc gap is held fixed by a tack weld until the brazing with the RF-coil can be completed.

The lamp 200 therefore has fewer parts, uses less expensive materials, requires simpler tooling, and needs fewer assembly steps, compared to conventional CERMAX-type arc lamps.

Tables I and II compare the component costs for similar CERMAX-type lamps. Table I represents the component costs in 1999 for lamp 100 in FIG. 1. Table II represents the component costs in 1999 for lamp 200 in FIG. 2.

TABLE I

| | | |
|---|---|---|
| 1 | sapphire window 104 | 10% |
| 2 | window shell flange 106 | 1.3% |
| 3 | body sleeve 108 | 7.8% |
| 4,5 | flanges 110, 112 | 1.1% |
| 6,7,8 | struts 114 | 1.9% |
| 9 | cathode 116 | 3.7% |
| 10 | elliptical reflector 118 | 30.9% |
| 11 | shell 120 | 1.9% |
| 12 | anode base 122 | 9.2% |
| 13 | base support ring 124 | 4.3% |
| 14 | tungsten anode 126 | 4.5% |
| 15 | tubulation 128 | 1.8% |
| 16 | xenon gas 130 | 7.5% |
| 17 | window coatings 102 | 14.1% |
| | MATERIAL SUBTOTAL | 48% |
| | LABOR SUBTOTAL | 52% |
| | LAMP DIRECT COST | 100% |

The lamp 200 uses six fewer components, compared to lamp 100. Tables I and II show that the labor costs are reduced by fifty-nine percent. Material costs are reduced by twenty-five percent. Overall savings are better than thirty-eight percent

TABLE II

| | | |
|---|---|---|
| 1 | sapphire window 204 | 10.0% |
| 2 | window shell flange 206 | 2.3% |
| 3 | tubulation 210 | 1.8% |
| 4 | body sleeve 208 | 5.5% |
| 5 | single Kovar strut 214 | 2.8% |
| 6 | cathode 116 | 3.7% |
| 7 | elliptical reflector 218 | 19.4% |
| 8 | anode flange 220 | 3.6% |
| 9 | anode 222 | 4.3% |
| 10 | xenon gas 212 | 7.5% |
| 11 | window coatings 202 | 14.1% |
| | MATERIAL SUBTOTAL | 75% |
| | LABOR SUBTOTAL | 40% |
| | LAMP DIRECT COST | 62% |

A principle reason the labor costs can so dramatically be reduced is the assembly of lamp 200 very much lends itself to automated mass-production techniques. In particular, the differences in the strut assembly and the way the xenon gas is injected help with automating the manufacturing.

In operation, a pair of aluminum heatsinks are attached to the lamp 200. The forward of the two heatsinks is contoured to fit the metal body sleeve 208 and must be relieved clear the xenon gas-fill tubulation after it has been pinched off. The aft heatsink is contoured to snug-fit around the node flange 220 and tungsten anode 222. Such heatsinks also provide convenient electrical connections in that they are respectively connected to the cathode 216 and anode 222.

FIG. 3 illustrates a xenon short-arc lamp embodiment of the present invention, and is referred to herein by the general reference numeral 300. Such lamp 300 preferably uses the components illustrated in FIG. 2 and is therefore similar in construction to lamp 200. ;

The lamp 300 comprises a xenon atmosphere 302 within which is disposed a cathode 304 supported by three-legged cathode-suspension strut system 306, and an anode 308. The xenon atmosphere 302 is enveloped by a ceramic body 310, an elliptical reflective surface mirror 312, a sapphire lens 314, and a copper base 316. It is important that the cathode 304 be suspended and held firmly in its proper place. The three-legged suspension strut system 306 resists three-dimensional flexing and inter-electrode gap variations between the cathode and anode. An outer lamp-front-end ring 318 necks down to a smaller diameter into which is brazed a suspension ring 320. A lens cup 322 has its inside forward surface sealed to the sapphire lens 314 The combination of the outer lamp-front-end ring 318, the suspension ring 320, the lens cup 322, and the sapphire lens 314, provide a complete seal of the forward end of the ceramic body 310 to contain the xenon atmosphere 302.

The lens cup 322 has special cutouts in its rear flat panel that allow three struts to be formed by bending out a portion of each of three webbings. After bending, each strut has an L-shaped cross-section and is structurally quite rigid. Kovar sheet about 0.020 inches thick is generally preferred for the outer lamp-front-end ring 318, the suspension ring 320, and the lens cup 322. The cathode 304 and anode 308 are generally preferred to be made from tungsten. The outer lamp-front-end ring 318 provides an electrical contact for the cathode to an igniter. The base 316 provides an electrical contact between the anode 308 and the igniter.

FIGS. 4A, 4B, 5A, and 5C represent a three-legged suspension strut system embodiment of the present invention, and is referred to by the general reference numerals 400 and 500. The strut system 400 is shown before each of three flaps 402, 404, and 406 are folded over 90°. Such folds are made along the dashed lines on the webbing in the drawing. The flaps are fabricated as cutouts in a cup 408. A ring 410 is brazed to the outer edge of the cup 408 and allows for some expansion and contraction to occur without stressing the ceramic body of an arc lamp that the combination attaches to. A cathode electrode 412 is brazed to the center, and is typically 3.016 inches long. The cup 408 is typically made of 0.020 inch Kovar sheet material, has a typical outer diameter of 3.048 inches, and a depth of 0.245 inches.

The strut system 500 is shown after each of the three flaps are folded over to complete each of three struts 502, 504, and 506, respectively. A cup 508 is shown after bending the struts. A ring 510 and a cathode 512 are equivalent to the ring 410 and cathode 412 of FIGS. 4A and 4B. A sleeve 514 is slipped over the cathode 512 before brazing and helps bridge a braze-fillet area between each strut and the cathode. The sleeve 514 is typically made of 0.125 inch diameter Kovar rod 0.145 inches long and drilled with a 0.066 inch central bore. Three longitudinal slots, 0.022 inches wide and 0.010 inches deep, can be provided to receive the inside edges of each strut.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved xenon arc lamp with a cathode and anode electrode in a xenon atmosphere for lower manufacturing costs, the improvements comprising:

a metal lamp-body sleeve sealed to a window shell flange with a sapphire window;

a strut assembly connected at three points along an outer rim of said body sleeve and supporting a suspended cathode electrode;

a ceramic elliptical reflector attached at a front-end to the single-piece strut assembly and the metal lamp-body sleeve, and having a flat back-end with a central hole;

an anode flange having a hollow aft sleeve and a flared flat front lip that is attached along a flat surface to said flat back-end of the reflector; and an anode electrode in the shape of a shaft that is inserted into said hollow aft sleeve of the anode flange and slips through said central hole in the reflector to be brought into near contact with said cathode electrode.

2. The improved xenon arc lamp of claim 1, further comprising:

a gas-fill tubulation attached to a side of the body sleeve that permits a charge of xenon gas to be injected during manufacture.

3. The improved xenon arc lamp of claim 1, further comprising:

a mercury doping included in a xenon atmosphere contained by the lamp.

4. The improved xenon arc lamp of claim 1, wherein:

the strut assembly is fabricated from a single piece of metal in which each of three flaps have been folded over to stiffen each of three support arms.

5. An improved xenon arc lamp with a cathode and anode electrode in a xenon atmosphere for lower manufacturing costs, the improvements comprising:

a metal lamp-body sleeve sealed to a window shell flange with a sapphire window;

a strut assembly fabricated from a single piece of metal in which each of three flaps have been folded over to stiffen each of three support arms, and connected at three points along an outer rim of the body sleeve and supporting a suspended cathode electrode;

a ceramic elliptical reflector attached at a front-end to the strut assembly and the metal lamp-body sleeve, and having a flat back-end with a central hole;

an anode flange having a hollow aft sleeve and a flared flat front lip that is attached along a flat surface to said flat back-end of the reflector;

an anode electrode in the shape of a shaft that is inserted into said hollow aft sleeve of the anode flange and through said central hole in the reflector to be positioned into near contact with said cathode electrode;

a gas-fill tubulation attached to a side of the body sleeve to permit a charge of xenon gas to be injected during manufacture; and a mercury doping included in a xenon atmosphere contained by the lamp.

6. A method for manufacturing a xenon arc lamp with a metal lamp-body sleeve sealed to a window shell flange with a sapphire window, a gas-fill tubulation attached to a side of the body sleeve that permits a charge of xenon gas to be injected during manufacture, a single-piece strut assembly connected at three points along an outer rim of said body sleeve and supporting a suspended cathode electrode, a ceramic elliptical reflector attached at a front-end to the single-piece strut assembly and the metal lamp-body sleeve, and having a flat back-end with a central hole, an anode flange having a hollow aft sleeve and a flared flat front lip that is attached along a flat surface to said flat back-end of the reflector, and an anode electrode in the shape of a shaft that is inserted into said hollow aft sleeve of the anode flange and slips through said central hole in the reflector to be brought into near contact with said cathode electrode, the method comprising the steps of:

assembling said window shell flange, sapphire window, strut assembly, suspended cathode electrode, ceramic elliptical reflector, and anode flange;

slipping said anode electrode into said hollow aft sleeve of the anode flange;

contacting said cathode electrode with said anode electrode;

backing off said anode electrode enough to establish a predetermined arc gap; and brazing said anode electrode to said hollow aft sleeve of the anode flange.

* * * * *